US007771135B2

(12) United States Patent
Bizzotto

(10) Patent No.: US 7,771,135 B2
(45) Date of Patent: Aug. 10, 2010

(54) SCRUBBER AND CLEANING FLUID DISPENSER ASSEMBLY

(75) Inventor: Marco Bizzotto, Padova (IT)

(73) Assignee: The Libman Company, Arcola, IL (US)

( * ) Notice: Subject to any disclaimer, the term of this patent is extended or adjusted under 35 U.S.C. 154(b) by 1086 days.

(21) Appl. No.: 11/277,357

(22) Filed: Mar. 23, 2006

(65) Prior Publication Data

US 2007/0223989 A1 Sep. 27, 2007

(51) Int. Cl.

| | |
|---|---|
| ***B43K 8/12*** | (2006.01) |
| ***B43K 5/00*** | (2006.01) |
| ***B43K 8/00*** | (2006.01) |
| ***B43K 1/06*** | (2006.01) |
| ***B05C 21/00*** | (2006.01) |
| ***B05C 11/00*** | (2006.01) |
| ***B43M 11/06*** | (2006.01) |
| ***A47L 13/30*** | (2006.01) |

(52) U.S. Cl. ..... 401/207; 401/196; 401/266; 401/265; 401/261

(58) Field of Classification Search ..... 401/196, 401/198, 200, 202, 207, 118–130
See application file for complete search history.

(56) References Cited

U.S. PATENT DOCUMENTS

| | | | | | |
|---|---|---|---|---|---|
| 4,055,029 | A | * | 10/1977 | Kalbow | 451/527 |
| D387,704 | S | * | 12/1997 | Berti | D4/114 |
| 5,967,685 | A | * | 10/1999 | De Laforcade | 401/190 |
| 6,152,635 | A | * | 11/2000 | Wu | 401/270 |
| 6,250,833 | B1 | * | 6/2001 | Perry et al. | 401/278 |
| 6,425,701 | B1 | * | 7/2002 | Jacobs | 401/6 |

* cited by examiner

*Primary Examiner*—Huyen Le
*Assistant Examiner*—Ryan A Varnum
(74) *Attorney, Agent, or Firm*—Banner & Witcoff, Ltd.

(57) ABSTRACT

A dispenser assembly includes an elongated container with a shoulder configured to interface with a scrubbing assembly. The scrubbing assembly includes a support structure from which a deformable tab extends. The deformable tab is configured to cooperatively engage a recess in the container. During removal of the scrubber assembly, the deformable tab is deformed, thus aiding in the removal of the scrubber assembly from the elongated container.

19 Claims, 5 Drawing Sheets

SCRUBBER AND CLEANING FLUID DISPENSER ASSEMBLY

FIELD OF THE INVENTION

Aspects of the invention are directed towards a system for cleaning. More specifically, embodiments of the invention relate to an assembly including a scrubbing surface and dispenser for a cleaning fluid.

BACKGROUND OF THE INVENTION

A combined scrubbing surface and cleaning fluid dispenser assembly is a useful household cleaning implement for various purposes. In typical configurations, the dispenser assembly may include a container for holding a cleaning fluid, such as liquid soap or other cleaning substance, and a scrubbing surface, such as a sponge, that is operatively mounted to the container. When the dispenser assembly is used, pressing the scrubbing surface against any other surface, such as an object that is being cleaned, causes the cleaning fluid in the container to enter the scrubbing surface and become available for cleaning. Thus, it is intended that the person using the dispenser assembly does not have to repeatedly reapply cleaning fluid from a separate container to the scrubbing surface while cleaning. Thus, dispenser assemblies may be highly efficient implements for cleaning dishes and the like.

The container may include an inlet configured to mate with a cap so that the user can remove the cap, add cleaning fluid through the inlet to refill the container, and then reattach the cap to close the container. The container also may include an outlet operatively connected to the scrubbing surface in such a way as to facilitate flow of cleaning fluid from the container to the scrubbing surface.

Although cleaning fluid in the dispenser assembly may be refilled so that the assembly may be re-useable, eventually the scrubbing surface may degrade due to wear. To accommodate replacement of the scrubbing surface without requiring the user to purchase a new dispenser assembly, the scrubbing surface and the container may be separable. The scrubbing surface may include a support structure that may be attached to the container. Thus, it may be possible to remove the existing scrubbing surface and attach a new scrubbing surface to the same container.

One design consideration of such an assembly is that the scrubbing surface should be sufficiently secured to avoid having the scrubbing surface inadvertently separate from the container during use, particularly when the dispenser assembly is used in a vigorous manner. As a result, the scrubbing surfaces often are difficult to remove. Users with limited strength may find it difficult, if not impossible, to remove a scrubbing surface.

One dispenser assembly provides a recessed portion in an outer surface of the container and a corresponding rigid detent on the support structure. When the container and support structure are joined, the detent engages the recessed portion in the outer surface to secure the assembly and limit movement of the support structure to avoid disengagement from the container under normal operating conditions. To remove the support structure from the container, the user must exert a force on the support structure sufficient to cause the rigid detent to be disengaged from the recessed portion, so that the container may be separated from the support structure. However, given the required stiffness of the container and support structure, a substantial amount of force may be needed disengage the detent from the recessed portion. Thus, existing assemblies may be very difficult to disassemble.

There remains a need for an assembly in which a scrubbing surface will remain attached to a container while in use but can be readily removed by a user when it is desired to replace the scrubbing surface.

BRIEF SUMMARY OF THE INVENTION

In an aspect of the present invention, a container includes an inlet with a closure, an internal cavity for holding cleaning fluid, and a gripping portion. The container is configured to operatively engage a scrubbing surface. The scrubbing surface includes a support structure to facilitate attachment to the container. A deformable tab extends from the support structure base and interfaces with the container to hold the scrubbing surface in position during use. When desired, removal of the scrubbing surface is facilitated by the deformation of the tab so that the user can readily and easily separate the scrubbing surface from the container.

BRIEF DESCRIPTION OF THE DRAWINGS

Aspects of the present invention are illustrated by way of example and not limited in the accompanying figures in which like reference numerals indicate similar elements.

DETAILED DESCRIPTION OF THE INVENTION

It is noted that various connections are set forth between elements in the following description. These connections in general, unless specified otherwise, may be direct or indirect, and this specification is not intended to be limiting in this respect.

Aspects of the present invention relate to a dispenser assembly that includes a scrubbing surface and a container for holding a cleaning fluid. Such dispenser assemblies may have a variety of uses throughout the home. For example, they can be used to wash dishes or other items. The dispenser assembly allows an individual to clean dishes without requiring that the user directly hold the scrubbing surface. As another example, the dispenser assembly can be used to clean surfaces in the kitchen and bath, such as sinks, tubs, toilets and the like. The dispenser assembly limits exposure of the user's hands to water and potentially harsh cleaning fluid, where such exposure can otherwise lead to chapping or other irritations of the skin.

Dispenser assemblies in accordance with various embodiments of the invention may include a container with a removable scrubbing surface. The scrubbing surface may be a sponge or similar material, an abrasive pad or similar material, or combinations of a sponge and abrasive pad. Although aspects of the invention will be described and illustrated herein in connection with a sponge with abrasive outer surface, embodiments of the invention are not intended to be limited to sponges, and other scrubbing surfaces are contemplated.

Figure 1:
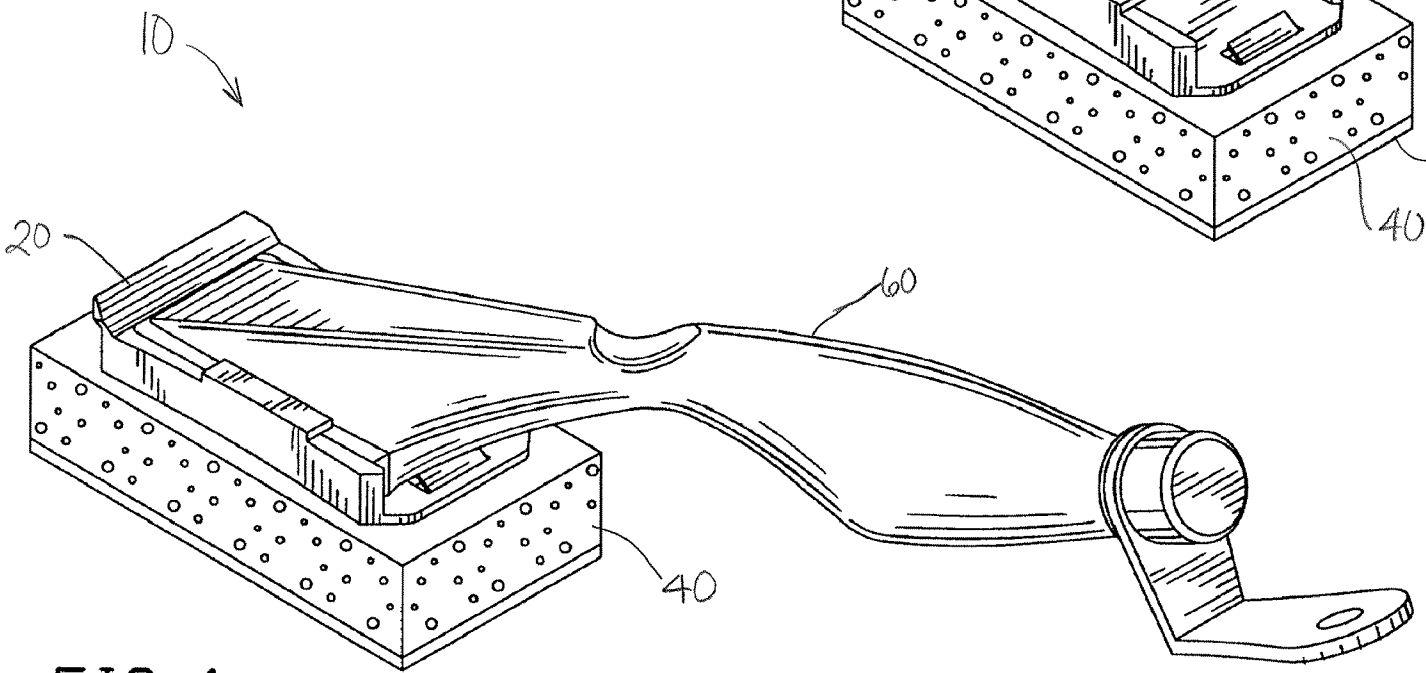
FIG. 1 illustrates an isometric view of a dispenser assembly according to an aspect of the present invention.
Figure 5:
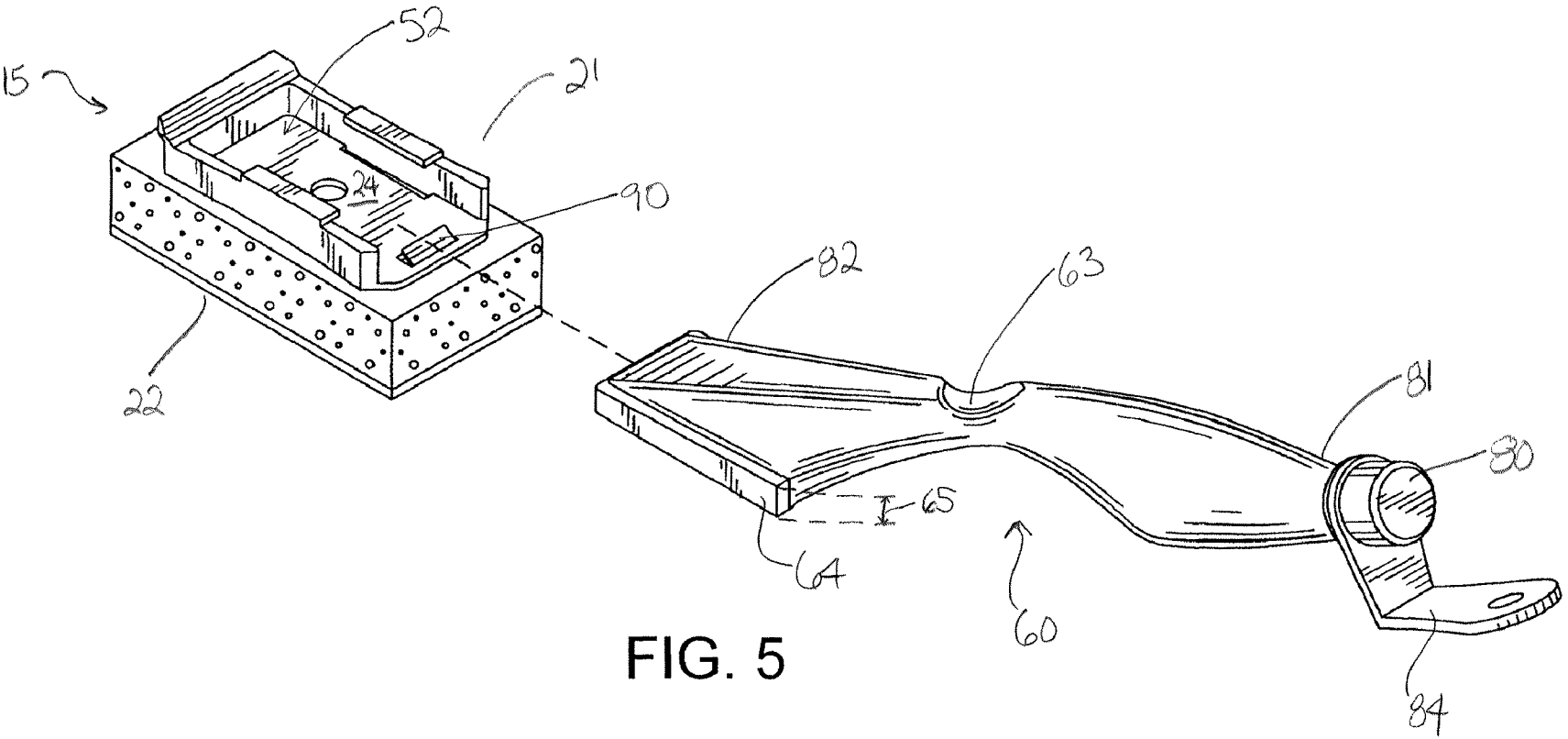
FIG. 5 illustrates an exploded view of the dispenser assembly of FIG. 1.
Figure 6:
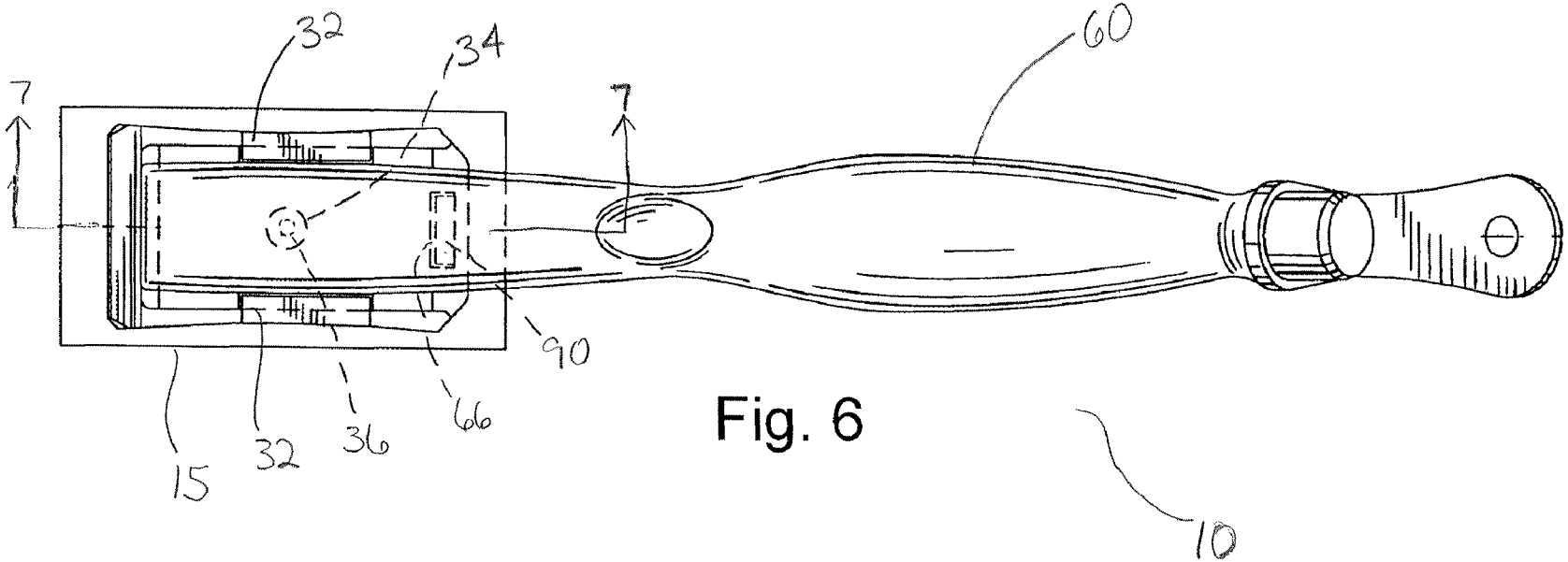
FIG. 6 illustrates a top plan view of the dispenser assembly of FIG. 1.

FIGS. 1 and 5 illustrate an embodiment of a dispenser assembly 10. The dispenser assembly 10 includes a removable scrubber assembly 15 that includes a support structure 20 and a sponge 40. An outer surface of the sponge may include an abrasive surface 45 for enhanced scrubbing. The assembly 15 is removably attached to a container 60.

The container 60 includes an internal cavity for holding cleaning fluid. As depicted, the container 60 is shaped for easy gripping, i.e., the container is shaped as an elongate handle. In other embodiments, the container and internal cavity may be otherwise configured, and a handle or other gripping structure may extend from the container. That is, the handle or other gripping structure may be a separate feature of the container and be separate from that portion that includes the cavity for holding cleaning fluid. The container includes a distal end 81 and a proximal end 82.

Figure 2:
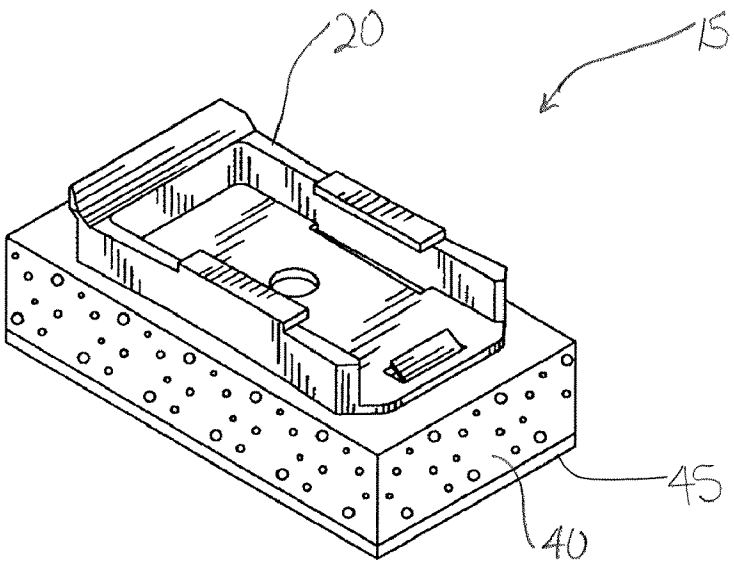
FIG. 2 illustrates an isometric view of a removable scrubber assembly of the dispenser assembly of FIG. 1.
Figure 3:
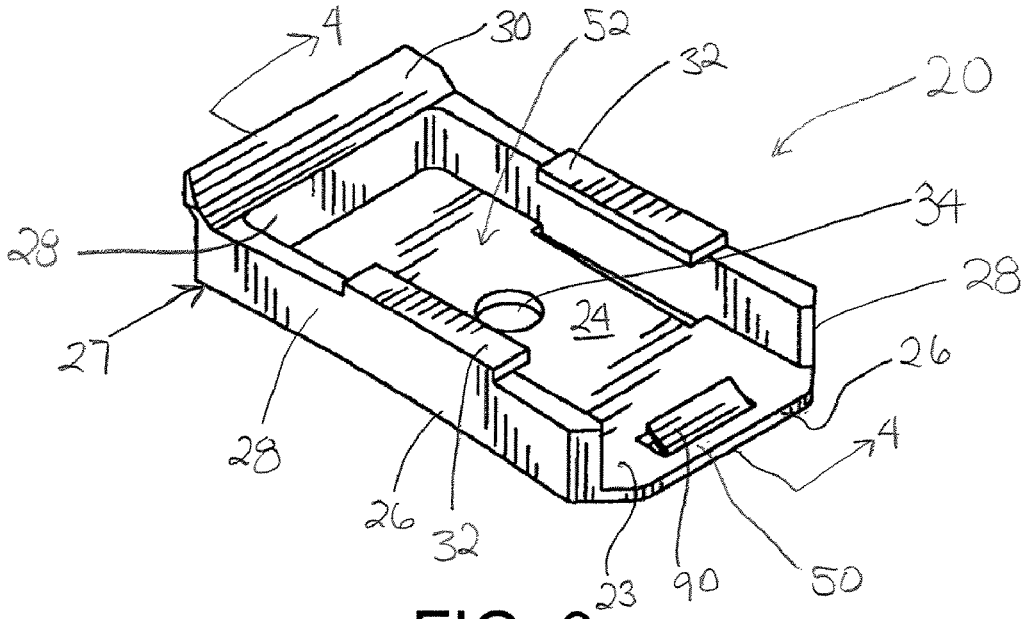
FIG. 3 illustrates an isometric view of the support structure of the scrubber assembly of FIG. 2.
Figure 4:
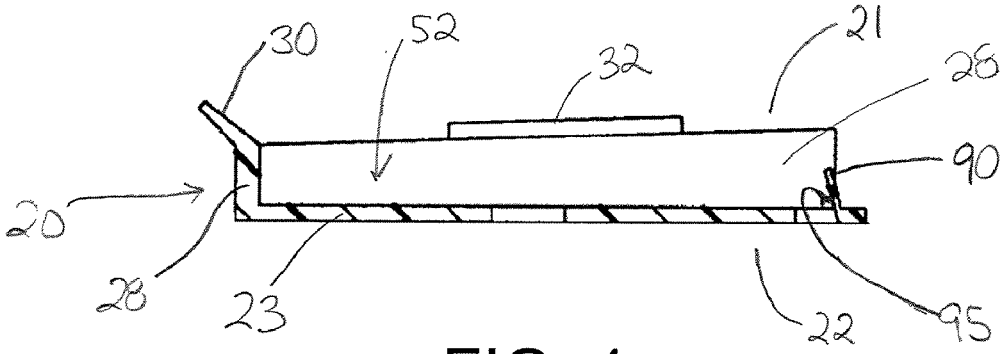
FIG. 4 illustrates a cross-sectional view along line 4-4 of the support structure of FIG. 3.

Referring also to FIGS. 2-4, there is illustrated an embodiment of the removable scrubber assembly 15. As depicted, the generally rectangular support structure 20 has a first side 21 and a second side 22. The support structure 20 includes a generally planar base wall 23 having a first surface 24. The support structure 20 is mounted to a surface of the sponge 40 along the base wall 23 with the first surface 24 facing away from the sponge 40. The support structure 20 is mounted at the second side 22 to the sponge 40 using any suitable fastening method, including but not limited to adhesive substances, such as glue, or mechanical fasteners, such as staples. In important aspects, the support structure 20 is mounted to the sponge 40 in a permanent or semi-permanent manner.

The support structure 20 has an outer perimeter 27 that includes a plurality of edges 26. A wall 28 extends from the first surface 24. As depicted, the wall 28 extends in a generally continuous manner along two opposing edges 26 and along the edge spanning between the two opposing edges, leaving an open segment 50 along the perimeter 27. Although having a continuous wall 28 provides certain benefits, including increased strength and stability, the wall 28 may be formed of discontinuous segments adjacent the perimeter 27. Furthermore, although depicted as extending from the perimeter 27 of the support structure 20, the wall 28 could be located interior of the perimeter 27. Lips 32 extend inwardly from the wall 28 in one or more locations. In an important aspect, the wall 28 and lips 32 are configured to receive a portion of the container 60 for engagement of the scrubber assembly 15 and container 60.

Although the support structure 20 and sponge 40 are depicted as being generally rectangular, other shapes also are contemplated. For example, the support structure and sponge may be circular, oval, or square shaped. The support structure and sponge also may have any other desired geometry.

The support structure 20 forms an attachment interface 52 for receiving a correspondingly-shaped portion of the container 60 at the proximal end 82. As depicted, the attachment interface 52 is formed on the first side 21 by the combination of the one or more walls 28, the one or more lips 32 and the first surface 24. Although depicted as being formed on the support structure 20, a similar attachment interface could be formed on the proximal end 82 of the container 60.

The support structure 20 includes a hinged tab 90 extending upwardly from the base wall 23. The hinged tab 90 is disposed adjacent the open portion 50 and extends generally parallel to the perimeter 27. The hinged tab 90 is configured to fit within and be received by a recessed portion 66 (FIG. 7) in the lower surface 68 (FIG. 7) the proximal end 82. In certain aspects, the hinged tab 90 may be formed from the base wall 23, for example, by a three-sided cut made in the base wall 23. The cut out portion is raised and rotated upwardly away from the base wall 23 to provide a generally flat tab hingedly connected along one edge to the base wall 23.

The hinged tab 90 is disposed at an angle from the plane of the base wall 23. In certain aspects, the angle formed by the first surface 24 of the base wall 23 and the hinged tab 90 ranges between about 1° and about 89°, between about 10° and about 80°, between about 20° and about 70°, between about 30° and about 60°, and between about 40° and about 50°. In other aspects, the angle between the first surface 24 and the hinged tab 90 ranges between about 20° and about 50°, between about 20° and about 45°, and between about 30° and about 50°. In yet another aspect, the angle between the first surface 24 and the hinged tab 90 is about 45°.

In certain embodiments, the hinged tab 90 is supported on its underside by a rib 95 or other raised portion. In some embodiments, an effective amount of a resilient substance may be used to form the rib 95. The rib 95 provides additional support for the hinged tab 90 so that the hinged tab 90 is maintained raised at an angle with the base wall 23.

Referring again to FIG. 5, the proximal end 82 of the container 60 includes a shoulder 64 that is configured to interface with the support structure 20. The shoulder 64 extends along one or more sides of the proximal end 82.

To engage the proximal end 82 of the container 60 with the attachment interface 52 of the sponge assembly 15, the proximal end 82 is moved into the attachment interface 52 through the open segment 50. The shoulder 64 slides under the lips 32 and into and engaged position in the attachment interface 52. The height 65 of the shoulder 64 is sized to fit between the lips 32 and the first surface 24. In certain aspects, the height 65 is equal to or slightly less than the distance between the underside of the lip 32 and the first surface 24 to allow the shoulder 64 to be press fit into the attachment interface 52.

Figure 7:
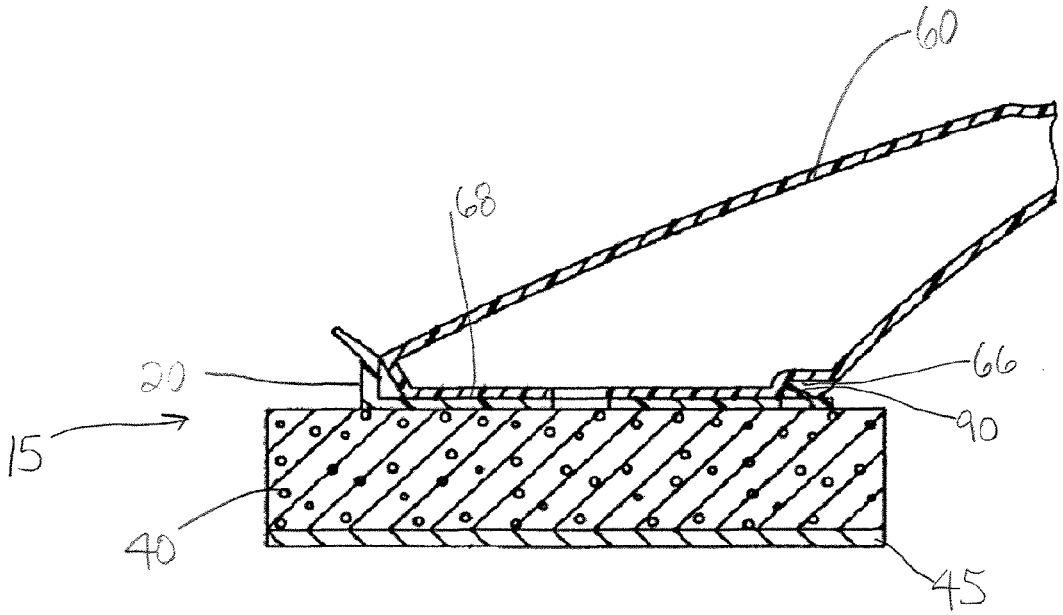
FIG. 7 illustrates a partial cross-sectional view along line 7-7 of the dispenser assembly of FIG. 6.

As the proximal end 82 is moved into the engaged position, the lower surface 68 slides over the hinged tab 90. As a result, the hinged tab 90 may be deflected downwardly toward the base wall 23. The rib 95, however, supports the hinged tab 90 and helps prevent the hinged tab 90 from being deformed and pushed generally flush with the base wall 23. Referring also to FIG. 7, the support structure 20 is attached to the container 60 with the first surface 24 facing inwardly and positioned adjacent the lower surface 68 of the container 60. In this manner, the sponge 40 extends away from the container 60. When the container 60 is joined with the scrubber assembly 15, the hinged tab 90 engages a rearward-facing surface of the recess 66.By engaging the recess 66, the hinged tab 90 acts to limit backward movement of the support structure 20 that may occur during normal use and may result in the inadvertent removal of the scrubber assembly 15 from the container 60.

Figure 8:
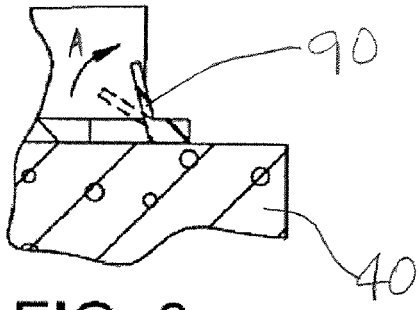
FIG. 8 illustrates a partial cross-sectional view the removable scrubber assembly of FIG. 2, showing the deflection of the hinged tab.

After a period of use, the sponge 40 and/or the abrasive surface 45 (if provided) may wear sufficiently so that the consumer may seek to replace the scrubber assembly 15. When it is desired to remove the scrubber assembly 15 from the container 60, the container 60 is pulled away from the scrubber assembly 15 in a generally lateral direction. As the shoulder 64 slides out from under the lips 32, the recess 66 and lower surface 68 will contact, and initially be stopped by, the hinged tab 90. With reference also to FIG. 8, pulling the container 60 away from the support structure 20 will cause the hinged tab 90 to deflect in a direction A. The hinged tab will deflect to allow lateral movement of the container 60 so that it can be removed from the engagement interface 52. In certain aspects, the hinged tab 90 will break away from the support structure 20. Thus, the hinged tab 90 is deformable, and the deformation of the hinged tab 90 allows the scrubber assembly 15 to be more readily removed and replaced. In certain aspects, additionally pulling down slightly on the support structure 20 as the container is pulled away may further facilitate removal of the scrubber assembly 15.

Once the scrubber assembly 15 is removed, a different scrubber assembly 15 may be attached to the container 60 in the manner discussed above.

The dispenser assembly 10 may include other features. An opening (not shown) at the distal end 81 is covered by a cap 80 or other closure. The opening is of any size and shape to allow a user to fill the container with cleaning fluid. The closure also may be located at any other suitable position on the container that will allow filling of the recess with cleaning fluid.

A first opening 34 is provided in the base wall 23 of the support structure 20. The first opening 34 is positioned to correspond generally to a second opening 36 in the proximal end 82 of the container 60. When the support structure 20 is attached to the container 60, cleaning fluid flows from the container 60 through the second opening 36, through the first opening 34 and into the sponge 40, where it becomes available for use.

A hanger 84 may be provided at the distal end 81, either integral with or separate from the cap 80, and, if provided, provides a ready means for hanging the dispenser assembly 10, both for retail purposes and when not in use.

The container 60 may include features to enhance gripping of the container 60. For example, a depression 63 in the top surface is configured to assist a user in securely gripping the container 60 to limit slipping in the user's hands during use.

In certain embodiments, a scraper 30 extends from the support structure 20. This feature aids a user in cleaning hard to remove substances, such as food particles that may be stuck on the surface or object, such as dishes, pot, pans and the like, being cleaned.

The present invention has been described in terms of preferred and illustrative embodiments thereof. Numerous other embodiments, modifications and variations within the scope and spirit of the appended claims will occur to persons of ordinary skill in the art from a review of this disclosure.

What is claimed is:

1. A sponge system, comprising:

a base, the base having a first side and a second side;

wherein the first side of the base comprises a deformable hinged tab extending away from the base; and wherein the second side of the base comprises a scrubbing surface;

a container having a first surface configured to be aligned in a removable parallel arrangement against the first side of the base, the container further comprising a recess that upon alignment in the removable parallel arrangement, is configured to interface the deformable hinged tab of the base, and wherein the deformable hinged tab is configured to deflect towards the first side of the base during the parallel alignment of the first surface of container with the first side of the base and further configured to deflect away from the base during a removal of the container from the base.

2. The sponge system of claim 1, wherein the base includes a wall extending from the first side of the base, the wall including a first lip and a second lip.

3. The sponge system of claim 2, wherein the wall extends from a perimeter of the base, the perimeter having a first edge, a second edge, a third edge and a fourth edge, wherein the wall extends along the first edge, the second edge and the third edge.

4. The sponge system of claim 3, wherein the first lip extends inwardly.

5. The sponge system of claim 4, wherein the wall includes a scraper.

6. The sponge system of claim 1, wherein the scrubbing surface is a sponge.

7. A cleaning system, comprising:

a container configured to hold a cleaning fluid, the container having a first end and a second end, the second end including a shoulder with a sealing surface and a recess, and the container being configured to be moveable between an engaged position and a removed position;

a base having a first side and a second side, the first side including a first surface configured to mate to the sealing surface of the container;

a deformable tab, the deformable tab extending from the first side of the base, the deformable tab configured to interface with the recess on the shoulder, the deformable tab configured to deflect downward towards the base during attachment of the container to the base, wherein the deformable tab is configured to deflect away from the base when the container is moved from the engaged toward the removed position; and a sponge, the sponge connected to the second side of the base.

8. The cleaning system of claim 7, wherein the deformable tab comprises a hinged tab.

9. The cleaning system of claim 8, wherein the based includes a wall extending from the first side of the base along a portion of a perimeter, the wall having a first lip and a second lip, wherein the shoulder of the container is configured to be inserted between the first and second lips and the first surface of the base.

10. The cleaning system of claim 9, wherein the base includes a scraper.

11. The cleaning system of claim 10, wherein the cleaning system further comprises a cap engagable with an inlet of the container.

12. The cleaning system of claim 7, wherein the sponge includes a scrubbing layer.

13. The cleaning system of claim 7, wherein the container is elongated and the container includes a depression configured to aid in the gripping of the container.

14. A sponge apparatus, comprising:

a base having a first side and a second side;

a deformable tab extending from the first side of the base, wherein the deformable tab is configured to be deflected in a first direction toward the base during attachment of the base to the container and further configured to deflect in a second direction away from the base during removal of the base from the container, wherein the first direction is different than the second direction; and a sponge mounted on the second side of the base.

15. The sponge apparatus of claim 14, wherein the sponge comprises a scrubbing layer.

16. The sponge apparatus of claim 14, further comprising a wall extending from the first side of the base, the wall positioned at the perimeter of the base.

17. The sponge apparatus of claim 16, wherein the wall includes a first lip, the first lip configured, in operation, to hold the base in an installed position.

18. The sponge apparatus of claim 17, wherein the wall includes a second lip, the second lip configured, in operation, to hold the base in the installed position, the second lip being positioned opposite the first lip.

19. The sponge apparatus of claim 18, wherein the deformable tab is supported by an effective amount of a resilient substance.

* * * * *